US008696373B2

(12) United States Patent
Yagome et al.

(10) Patent No.: US 8,696,373 B2
(45) Date of Patent: Apr. 15, 2014

(54) LOW INSERTION FORCE CONNECTOR UNIT WITH SAFETY CIRCUIT UNIT

(75) Inventors: Sachiko Yagome, Makinohara (JP); Ayumu Ishikawa, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/634,633

(22) PCT Filed: Jul. 5, 2011

(86) PCT No.: PCT/JP2011/065323

§ 371 (c)(1), (2), (4) Date: Sep. 13, 2012

(87) PCT Pub. No.: WO2012/005231

PCT Pub. Date: Jan. 12, 2012

(65) Prior Publication Data

US 2013/0095683 A1 Apr. 18, 2013

(30) Foreign Application Priority Data

Jul. 7, 2010 (JP) ..... 2010-154461

(51) Int. Cl.
*H01R 13/62* (2006.01)

(52) U.S. Cl.
USPC ..... 439/310; 439/924.1

(58) Field of Classification Search
USPC ..... 439/310, 157, 372, 371, 924.1, 924.2
See application file for complete search history.

(56) References Cited

U.S. PATENT DOCUMENTS 5,713,691 A * 2/1998 Solberg ..... 403/322.2
5,829,994 A * 11/1998 Oda et al. ..... 439/157

(Continued)

FOREIGN PATENT DOCUMENTS

JP 7-41103 Y2 9/1995
JP 2000-048903 A 2/2000

(Continued)

OTHER PUBLICATIONS

International Search Report dated Aug. 9, 2011, issued for PCT/JP2011/065323.

*Primary Examiner* — Neil Abrams
*Assistant Examiner* — Phuongchi T Nguyen
(74) *Attorney, Agent, or Firm* — Edwards Wildman Palmer LLP

(57) ABSTRACT

An object is to surely connect and disconnect the safety circuit for connectors with good workability. A low insertion force connector unit with a safety circuit unit 1 is adopted. The low insertion force connector unit with a safety circuit unit 1 includes: a driving lever 5 having an arc-shaped gear 6, an arc-shaped notch 34 continued to the gear, an arc-shaped cam groove 16 formed in the same radius from a center axis 'm', and a straight groove 17 continued to the cam groove; a gear unit 8 having a circular gear 10 meshed with the arc-shaped gear and a spiral groove 9, and attached to the one connector 2; a first driven projection 11 provided on the other connector 3, and engaged with the spiral groove; one small connector 13 of the safety circuit unit 12 provided on the one connector movably in a connector fitting direction; a second driven projection 22 provided on the one small connector; and the other small connector 14 of the safety circuit unit 12 fixed to the other connector.

2 Claims, 6 Drawing Sheets

(56) References Cited

U.S. PATENT DOCUMENTS

| | | | | |
|---|---|---|---|---|
| 5,993,226 | A * | 11/1999 | Yamaguchi | 439/157 |
| 6,146,161 | A * | 11/2000 | Osawa | 439/140 |
| 6,231,359 | B1 * | 5/2001 | Inaba et al. | 439/157 |
| 6,305,957 | B1 * | 10/2001 | Fink et al. | 439/157 |
| 6,325,648 | B1 * | 12/2001 | Bilezikjian et al. | 439/157 |
| 7,217,150 | B2 * | 5/2007 | Lekic et al. | 439/352 |
| 7,438,570 | B2 * | 10/2008 | Mori et al. | 439/157 |
| 7,641,499 | B1 * | 1/2010 | George et al. | 439/352 |
| 7,789,690 | B1 * | 9/2010 | Rhein | 439/310 |
| 8,303,320 | B2 * | 11/2012 | Loncar et al. | 439/157 |
| 2001/0019909 | A1 * | 9/2001 | Sasaki et al. | 439/157 |
| 2005/0221648 | A1 | 10/2005 | Deno et al. | |
| 2009/0246991 | A1 * | 10/2009 | Shuey | 439/157 |

FOREIGN PATENT DOCUMENTS

| | | | |
|---|---|---|---|
| JP | 2003-346981 | A | 12/2003 |
| JP | 2005-294038 | A | 10/2005 |
| JP | 2006-073330 | A | 3/2006 |

* cited by examiner

LOW INSERTION FORCE CONNECTOR UNIT WITH SAFETY CIRCUIT UNIT

TECHNICAL FIELD

This invention relates to a low insertion force connector unit with a safety circuit unit configured to connect male and female connectors and to fit the safety circuit unit for connecting and disconnecting a circuit between both connectors by an operation of a driving lever.

BACKGROUND ART

Conventionally, various low insertion force connector units have been proposed for smoothly connecting male and female connectors to each other with a low insertion force.

For example, in Patent Document 1, a low insertion force connector unit configured to pull and connect a mating connector (not shown) by a rotational operation of a lever for, for example, electrically connecting a motor with an inverter of a hybrid vehicle is described.

In this low insertion force connector unit, the lever is rotatably engaged with a shaft at a side wall of a connector housing. A cam groove is formed on the lever for engaging slidably with a driven projection (not shown) of the mating connector. When the lever is rotated backward from a standing position, the mating connector is pulled backward and fitted with the connector. Adversely, when the lever is rotated forward to the standing position, both connectors are detached from each other back and forth.

Further, in Patent Document 2, a low insertion force connector unit configured to connect and detach both connectors from each other by inserting a cam bolt having a spiral groove into a connector housing, by inserting a projection of mating connector into the spiral groove, and by rotating the cam bolt with an operational handle is described.

PRIOR ART DOCUMENT

Patent Document

Patent Document 1: JP, A, 2005-294038 (FIG. 4)
Patent Document 2: JP, Y, H07-41103

DISCLOSURE OF THE INVENTION

Problem to be Solved by the Invention

However, in the conventional low insertion force connector unit described above, it is necessary to provide a safety circuit for preventing an operator from danger such as electrical shock when a vehicle is maintained or the like, for example, when a connection between a motor and an inverter as components of a hybrid vehicle is cut with a connector. In this case, it is necessary to surely connect and disconnect the safety circuit with good workability.

In view of the above point, an object of the present invention is to provide a low insertion force connector unit with a safety circuit unit able to surely connect and disconnect the safety circuit for connectors with good workability.

Means for Solving the Problem

For attaining the object, according to the invention claimed in claim 1, there is provided a low insertion force connector unit with a safety circuit unit comprising:

one connector;

the other connector;

a driving lever rotatably and pivotally supported by the one connector, and having an arc-shaped gear, an arc-shaped notch continued to the gear, an arc-shaped cam groove formed in the same radius from a center axis, and a straight groove continued to the cam groove;

a gear unit having a circular gear meshed with the arc-shaped gear and a spiral groove, and attached to the one connector;

a first driven projection provided on the other connector, and engaged with the spiral groove;

one small connector of the safety circuit unit provided on the one connector movably in a connector fitting direction;

a second driven projection provided on the one small connector; and the other small connector of the safety circuit unit fixed to the other connector, wherein the one and the other connectors are fitted to each other by meshing the arc-shaped gear with the circular gear, wherein when the connectors are fitted to each other, the second driven projection is moved along the cam groove, and wherein when the circular gear is inserted into the notch, the second driven projection is engaged with the straight groove.

According to the above configuration, in a set condition where the first driven projection of the other connector is inserted into a start point of the cam groove of the gear unit, and the second driven projection of the safety circuit unit is inserted into a start point of the spiral groove of the driving lever, when the driving lever is rotated, the arc-shaped gear rotates the circular gear, the first driven projection is pulled into the spiral groove, and the other connector is fitted to the one connector. At this time, the second driven gear is moved in the arc-shaped cam groove formed in the same radius from the center axis, and the one small connector of the safety circuit unit is not moved and maintained in a set position. After the one and the other connectors are fully fitted to each other, the second driven projection is inserted into the straight groove, and moved (driven) in the connector fitting direction together with the one small connector due to a rotation of the driving lever, thereby the one small connector is fitted to the other small connector, and the one and the other connectors are electrically connected to each other. When the safety circuit unit is fitted, the circular gear is positioned in the notch and not rotated, thereby further unnecessary fitting of the one and the other connectors is prevented. A release operation of the connectors and the safety circuit unit is carried out by an operation that is reverse to the above.

According to the invention claimed in claim 2, there is provided the low insertion force connector unit with a safety circuit unit as claimed in claim 1, wherein the driving lever further has an arc-shaped second gear for locking, continued to the notch, wherein the gear unit further has a second straight groove continued to the spiral groove in a direction perpendicular to the connector fitting direction, and wherein when the second gear is meshed with the circular gear, the first driven projection is inserted into the second straight groove.

According to the above configuration, after the one and the other connectors are fully fitted to each other, the driving lever is further rotated, thereby the second gear rotates the circular gear, and the first driven projection is inserted into the second straight groove from a stop end. Thereby, the connectors are locked in a direction perpendicular to the connector fitting direction, and the one and the other connectors are prevented from being released from each other unintentionally.

Effects of the Invention

According to the invention claimed in claim 1, fitting and releasing operations of the one and the other connectors, and fitting and releasing operations of the safety circuit unit can be sequentially done by a rotation of the one driving lever. Therefore, the safety circuit for connectors can be surely connected and disconnected with good workability.

According to the invention claimed in claim 2, after the one and the other connectors are fitted to each other, both connecters are locked by a rotation of the driving lever. Thereby, the one and the other connectors are prevented from being released from each other unintentionally, and the security of the connectors is increased.

DESCRIPTION OF EMBODIMENTS

FIGS. 1 to 6 show an embodiment of a low insertion force connector unit with a safety circuit unit according to the present invention.

Figure 1:
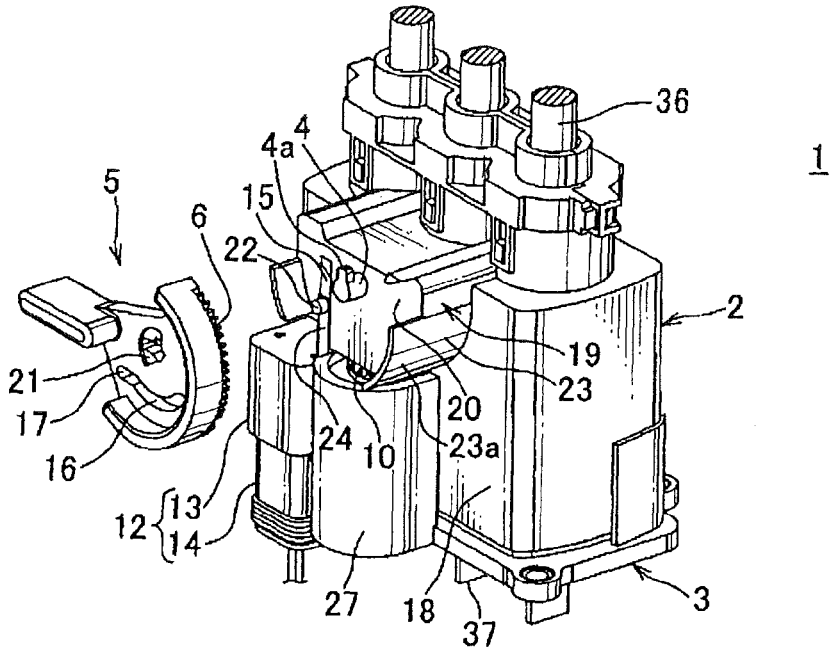
FIG. 1 An exploded perspective view showing upper and lower connectors fitted to each other according to an embodiment of a low insertion force connector unit with a safety circuit unit of the present invention.
Figure 2:
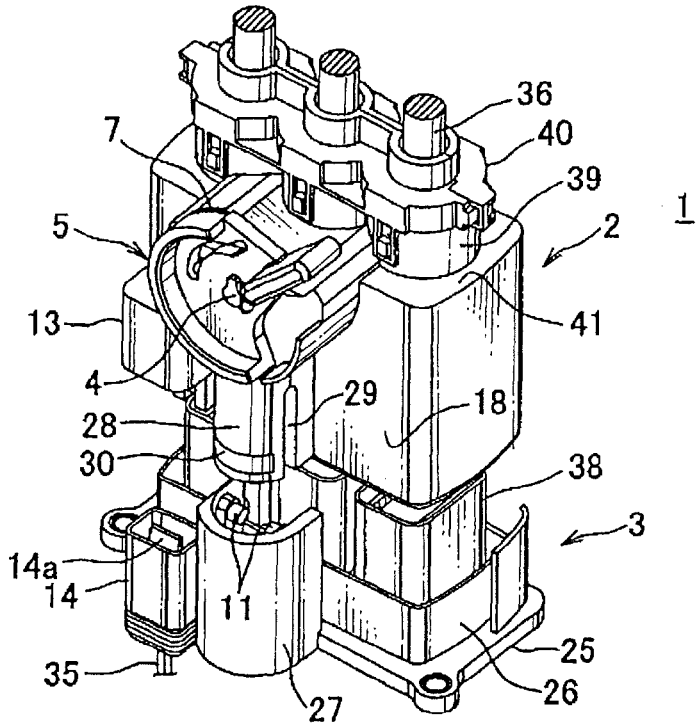
FIG. 2 An exploded perspective view showing the upper and lower connectors not fitted to each other of the low insertion force connector unit with a safety circuit unit.

As shown in FIGS. 1 and 2, this low insertion force connector unit with a safety circuit unit 1 includes: an upper one connector 2; a lower other connector 3 configured to be fitted to the one connector 2; a driving lever 5 rotatably attached to a horizontal shaft 4 of the upper connector 2; a substantially cylindrical gear unit 8 (FIG. 3) provided rotatably in the upper connector 2 and driven by a arc-shaped gear 6 formed on an outer periphery of the driving lever 5; a driven projection 11 (first driven projection in FIG. 2) of the lower connector 3 engaged with a spiral groove of the gear unit 8; a lower other small connector 14 of a safety circuit unit 12 fixed to the lower connector 3; an upper one small connector 13 of the safety circuit unit 12 elevatably mounted on the upper connector 2, and making a driven projection 22 (second driven projection) engaged with a cam groove 16 of the driving lever 5.

As shown in FIG. 1, a swelling wall 19 is provided on a vertical front wall 18 of an insulating-resin-made connector housing (also denoted by 2) of the upper connector 2. A horizontal short cylindrical shaft 4 is provided on a vertical front wall 20 of the swelling wall 19. The shaft 4 has a flange 4*a*. A circular hole 21 (FIG. 4) in the center of the driving lever 5 is engaged with the shaft 4, and the flange 4*a* is inserted into a rectangular notched hole 21*a* (FIG. 4) continued to the hole 21, thereby, as shown in FIG. 2, the driving lever 5 is attached rotatably in a horizontal direction on a virtual vertical wall.

A slit groove 15 perpendicular to the front wall 20 of the swelling wall 19 is provided vertically at a left side of the shaft 4. A lower end of the slit groove 15 is opened at a lower side of a peripheral wall 23 of the swelling wall 19. An upward vertical projecting wall 24 (FIG. 4) of the upper small connector 13 of the safety circuit unit 12 is elevatably engaged with the slit groove 15. A short cylindrical horizontal driven projection 22 (second projection) provided on an upper front end of the projecting wall 24 is projected forward from the slit groove 15. An arc-shaped guide wall 23*a* for guiding the driving lever 5 is projected from the peripheral wall 23.

Figure 3:
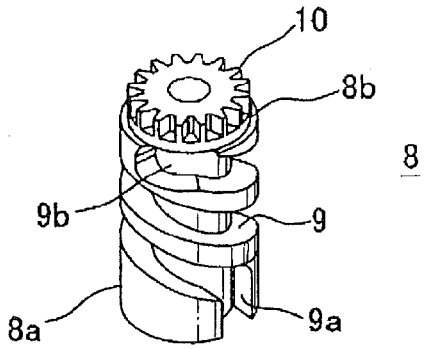
FIG. 3 A perspective view showing an embodiment of a gear unit attached to the upper connector.

As shown in FIGS. 1 and 2, a substantially half-cylindrical guide peripheral wall 27 is vertically and integrally provided at a front end side of a flange 25 and a vertical peripheral wall 26 disposed at a lower end of an insulating-resin-made connector housing (also denoted by 3) of the lower connector 3. A left and right pair of (one is also all right) horizontal short cylindrical driven projections 11 is integrally provided on an upper inner face of the guide peripheral wall 27. A substantially half-cylindrical small-radius receiving wall 28 (FIG. 2) is integrally provided on the front wall 18 at a lower side of the swelling wall 19 of the upper connector housing 2. A lower end of the receiving wall 28 is opened. The gear unit 8 shown in FIG. 3 is received in an inside of the receiving wall 28. The driven projections 11 are slidably engaged with the spiral hole 9 of the gear unit 8.

The receiving wall 28 includes a left and right pair of vertical guide slits 29 for elevatably guiding the pair of driven projections 11. A lower end of the slit 29 is opened outward. The receiving wall 28 includes a horizontal slit 30 in a circumferential direction at a lower part of the receiving wall 28. When a pair of driven projections 11 is provided, the number of grooves of the spiral groove (FIG. 9) is two, and when one driven projection 11 is provided, the number of grooves of the spiral groove is one.

The gear unit 8 shown in FIG. 3 integrally includes a horizontal circular gear 10 at an upper end thereof. The circular gear 10 is meshed with outer peripheral arc-shaped gears 6, 7 of the driving lever 5 as shown in FIGS. 1, 4 to 6. The spiral groove 9 of the gear unit 8 includes: a vertical straight entrance 9*a* at a lower side thereof and a horizontal straight groove 9*b* (a groove perpendicular to the center axis of the gear unit 8) at an upper side (stop end side) thereof. A diameter of the circular gear 10 is a little smaller than a cylindrical gear unit main body 8*a*. The circular gear 10 is continued to an outer peripheral wall of the gear unit main body 8*a* via an upper end receiving face 8*b*. A lower end face of the gear unit 8 is supported by, for example, a ring (not shown) attached to the horizontal slit 30 shown in FIG. 2, and thereby the gear unit 8 is prevented from falling out.

Figure 4:
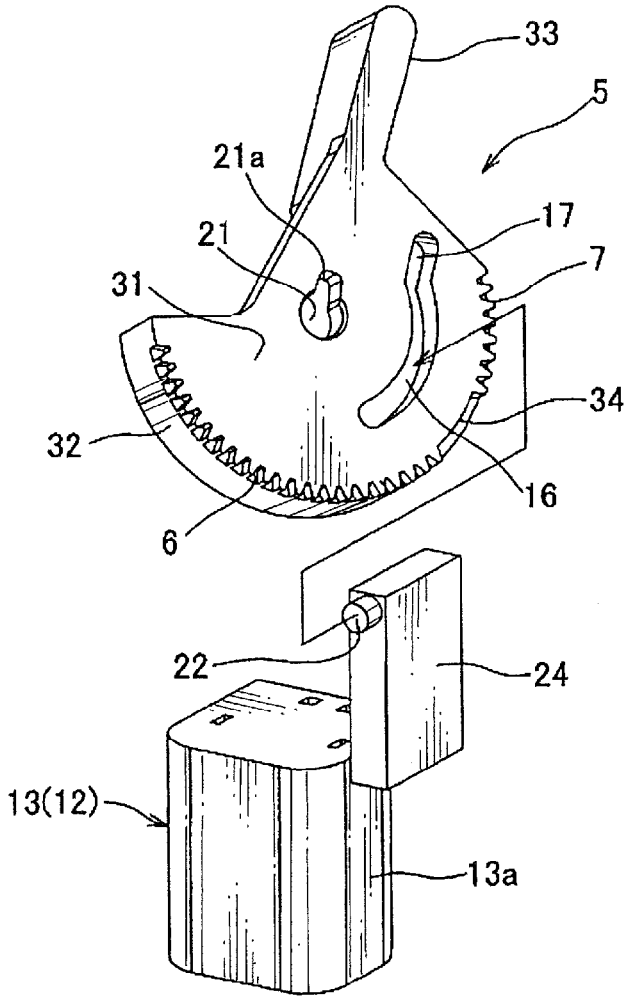
FIG. 4 An exploded perspective view showing an embodiment of a driving lever and a small connector at an upper side of the safety circuit unit attached to the upper connector.
Figure 5:
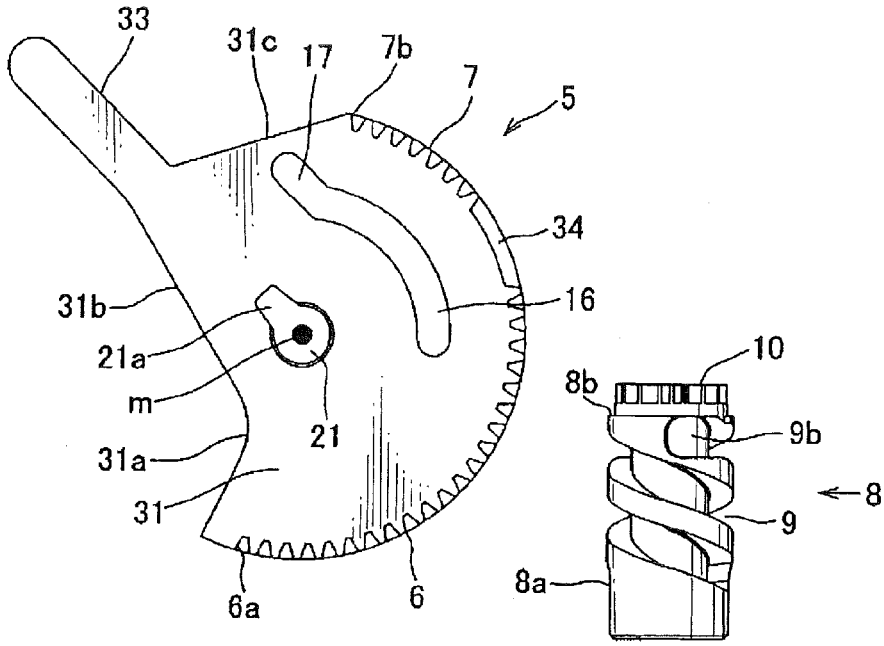
FIG. 5 A rear view showing the driving lever and the gear unit.
Figure 6:
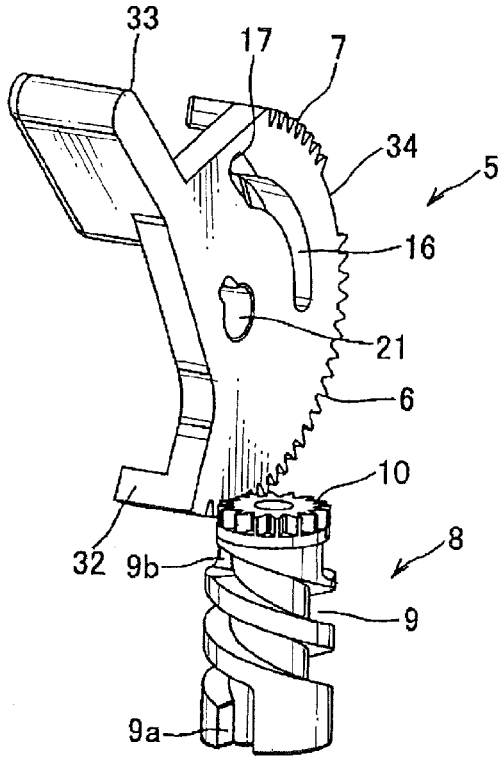
FIG. 6 A perspective view showing the driving lever and the gear unit meshed with each other.

As shown in FIGS. 4 to 6, the driving lever 5 includes: a substantially fan-shaped intermediate plate 31; an arc-shaped wall 32 extended on an outer periphery of the substantially semi-circular part of the intermediate plate 31; and a narrow operational plate 33 continued to a narrow side of the intermediate plate 31. A bearing hole composed of the circular hole 21 and the rectangular notched hole 21*a* is provided at the substantially center of the intermediate plate 31.

An arc-shaped first gear 6 extended long in a circumferential direction, an arc-shaped second gear 7 extended short in a circumferential direction, and an arc-shaped notch 34 having no gear between the first and second gear 6, 7 are provided on a semi-circular outer periphery of the intermediate plate 31. A length in the circumferential direction of the notch 34 is shorter than that of the second gear 7. Radiuses from the center 'm' (FIG. 5) of the circular hole 21, namely, the center of the shaft 4 (FIG. 1) to the first and second gears 6, 7 are the same and constant throughout the whole lengths thereof. A radius from the center of the circular hole 21 to the notch 34 having no gear is a little shorter than the radiuses from the center of the circular hole 21 to the first and second gears 6, 7.

An arc-shaped cam groove 16 is provided on the intermediate plate 31 in between the circular hole 21 and the first and second gears 6, 7 and extended from around a stop end of the long first gear 6 via the notch 34 to a stop end of the short second gear 7. A radius from the arc-shaped cam groove 16 to the center of the circular hole 21 is constant throughout the whole length of the arc-shaped cam groove 16. The arc-shaped cam groove 16 is continued to a short straight groove 17 (first straight groove) extended straight from an end of the second gear 7 toward the operational plate 33. A length of the straight groove 17 is a little shorter than that of the notch 34. A start end 6*a* (FIG. 5) of the first gear 6 is continued to the operational plate 33 via a substantially V-shaped bent side wall 31*a* and a long sloped side wall 31*b* of the intermediate plate 31. A stop end 7*b* of the second gear 7 is continued to the operational plate 33 via a short sloped side wall 31*c*.

A length of the horizontal straight groove 9*b* (second straight groove) at a stop end of the spiral groove 9 of the gear unit 8 shown in FIGS. 3 and 5 is substantially quarter of an outer periphery of the gear unit main body 8*a*. The driven projections 11 of the lower connector 3 shown in FIG. 2 are slidably engaged with the spiral hole 9.

The driven projection 22 of the upper small connector 13 of the safety circuit unit 12 shown in FIG. 4 slidably engaged with the cam groove 16 of the driving lever 5. The driven projection 22 is provided on a front top of the vertical plate-shaped projecting wall 24. The projecting wall 24 is integrally provided on a top of a right side sidewall 13*a* of the insulating-resin-made connector housing (also denoted by 13) of the small connector 13.

A substantially inverted U-shaped short terminal (not shown) is received in the small connector 13. In an insulating housing of the lower small connector 14, a pair of terminals (not shown) for abutting on the shot terminal is provided on a vertical insulating plate 14*a*. The pair of connectors are connected to slim electric wires 35 (FIG. 2), and the electric wires 35 are continued to a controller (not shown) for controlling connect and disconnect of a main circuit such as terminals (not shown) received in the upper and lower connector 2, 3, and electric wires 36 or bus bars 37 (FIG. 1) continued to the terminals. The safety circuit unit 12 is composed of the upper and lower small connectors 13, 14.

The long first gear 6 as shown in FIGS. 4 to 6 rotates the circular gear 10 (FIG. 5) of the gear unit 8. The spiral grooves 9 of the gear unit 8 move up and down the driven projections 11 of the lower connector 3. Thereby, the upper and lower connectors 2, 3 are fitted with each other and released from each other. During that time, the driven projection 22 of the upper small connector 13 slides at a constant position in the arc-shaped cam groove 16 of the driving lever 5 (because the radius from the axial center 'm' to the arc-shaped cam groove 16 of the driving lever 5 is constant along the whole length of the arc-shaped cam groove 16, only the cam groove 16 is rotated, and the driven projection 22 is not moved up and down). The circular gear 10 is stopped at the intermediate notch 34 between the first and second gear 6, 7 and the rotation of the gear unit 8 is stopped. When the driven projection 22 (FIG. 4) of the small connector 13 is inserted into the straight groove 17 of the can groove 16, the driven projection 2 is moved up and down, and the upper and lower connectors 13, 14 are fitted with each other and released from each other. When the circular gear 10 is meshed with the second gear 7, the upper and lower connectors 2, 3 are locked with each other. During that time, when the driven projections 11 (FIG. 2) of the lower connector 3 is inserted into the horizontal straight groove 9*b* at the stop end of the spiral groove 9 of the gear unit 8, the upper and lower connectors 2, 3 are mot moved up and down, namely, not fitted with or released from each other.

In FIG. 5, because the cam groove 16 is formed in an arc-shape around the shaft 4 (FIG. 2), the driven projection 22 of the safety circuit unit 12 is not pulled, and the safety circuit unit 12 is fixed to the upper female connector 2. Further, because the notch 34 between the first and second gears 6, 7 is neutral, after the upper and lower female and male connectors 2, 3 are fully fitted with each other, while the safety circuit unit 12 is pulled, the lower male connector 3 is not pulled. Further, after the upper and lower connectors 2, 3 are fully fitted with each other, the straight groove 17 at the stop end side of the cam groove 16 is engaged with the driven projection 22 of the safety circuit unit 12, and the safety circuit unit 12 is started to be fitted. Further, the horizontal straight groove 9*b* at the upper end of the gear unit 8 did not pull the driven projections 11 of the lower connector 3 even when the circular gear 10 is meshed with the second gear 7 of the driving lever 5. These operations will be explained in detail below with reference to FIGS. 7 to 11.

Figure 7:
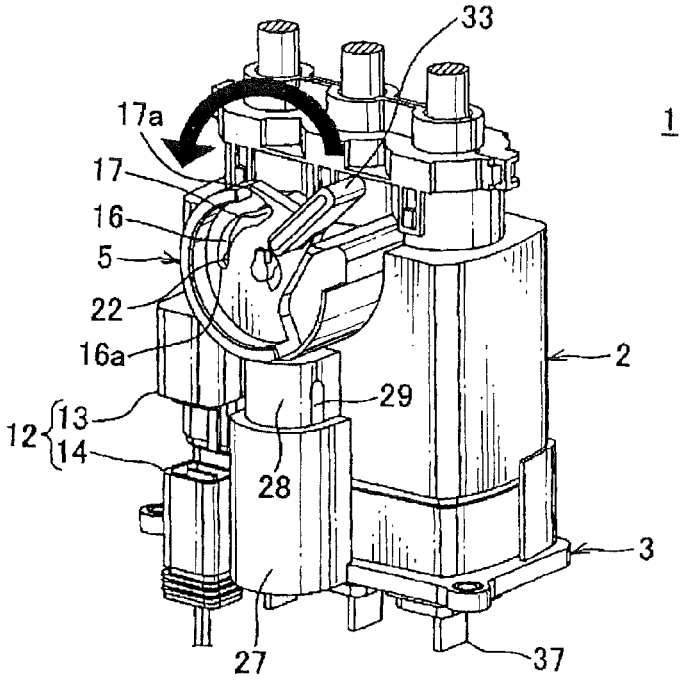
FIG. 7 A perspective view showing a set condition (initial condition) of the low insertion force connector unit with a safety circuit unit.

As shown in FIG. 2, the lower connector 3 includes a plurality of (three in this embodiment) terminal receiving portions 38 in parallel in an inside of the peripheral wall 26 of the connector housing. A male terminal is received in each terminal receiving portion 38. The mate terminal is integrally continued to a bus bar 37 (FIGS. 1 and 7). The bus bar 37 is connected to a circuit (not shown) in a device. A flange 25 at a lower end of the connector 3 is fixed to the device (not shown) with a bolt. Thus, the connector 3 works as a direct-mounted connector.

The upper connector 2 receives a plurality of (three) female terminals (not shown) in the connector housing. Each female terminal is connected to a shielded electric wire 36. The electric wire 36 is made watertight in a housing cylinder portion 39 with a rubber plug (not shown) in an insulating holder 40. It is also possible that the lower connector 3 includes a male terminal connected to an electric wire similar to the upper connector 2. The electric wire 36 is not limited to the shielded wire.

Further, the upper electric wire can be guided out horizontally backward, not upward, and the driving lever 5 can be arranged horizontally on the housing upper wall 41 not on the front wall 23, and the first gear 6 of the driving lever 5 can drive the circular gear 10 of the gear unit 8 in the vertical receiving wall 28 on the front wall 18. (This configuration has been proposed by the applicant of the present application in JP, A, 2010-108084. A difference between this and the present invention is presence or absence of the notch 34 between the first and second gears 6, 7 of the driving lever 5, the straight groove 17 of the cam groove 17, and the horizontal straight groove 9*b* at the upper end of the gear unit 8.)

Hereinafter, an operation of the low insertion force connector unit with a safety circuit unit 1 will be explained.

First, as shown in FIG. 7, before the upper and lower connectors 2, 3 are fitted with each other, and before the safety circuit unit 12 is fitted, the operational plate 33 of the driving lever 5 is inclined right. As shown in FIG. 6, a start end of the first gear 6 is meshed with the circular gear 10 of the gear unit 8 in the receiving wall 28. A start end 16*a* of the cam groove 16 is positioned at the lower side in a left side of the driving lever 5, a stop end 17*a* of the straight groove 17 is positioned at an upper side, and the arc-shaped cam groove 16 is inclined upper right. The driven projection 22 of the upper small connector 13 of the safety circuit unit 12 is engaged with a lower end 16*a* of the arc-shaped cam groove 16. From this set position, an operator rotates the operational plate 33 of the driving lever 5 in a counterclockwise direction as shown by an arrow.

Figure 8:
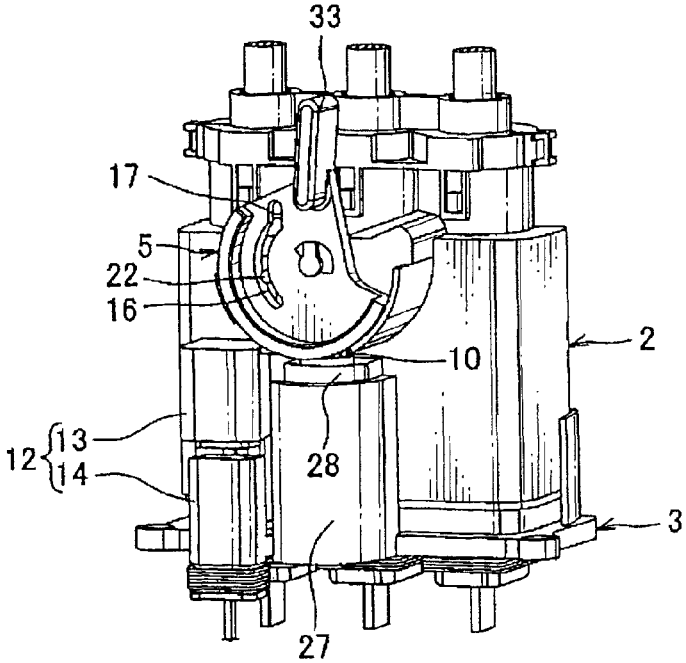
FIG. 8 A perspective view showing a condition that the upper and lower connectors are halfway to be fitted to each other.

As shown in FIG. 8, the first gear 6 of the driving lever 5 rotates the circular gear 10 of the gear unit 8. The driven projections 11 (FIG. 2) in the guide peripheral wall 27 of the lower connector 3 are pulled to the spiral groove 9 of the gear unit 8, and moved upward together with the lower connector 3. The lower connector 3 is pulled into the upper connector 2 having the driving lever 5 and the gear unit 8, and being fitted with the upper connector 2. While the operational plate 33 of the driving lever 5 stands up, the upper and lower connectors 2, 3 are in the middle of fitting, and in the safety circuit unit 12, the lower small connector 14 is moved upward together with the lower connector 3, but the fitting is not started. The driven projection 22 of the safety circuit unit 12 is positioned in the middle of (substantially the center of) the arc-shaped cam groove 16, and the driven projections 11 is not moved upward and positioned in the set position of FIG. 7. The cam groove 16 and the operational plate 33 are positioned in the up and down direction.

Figure 9:
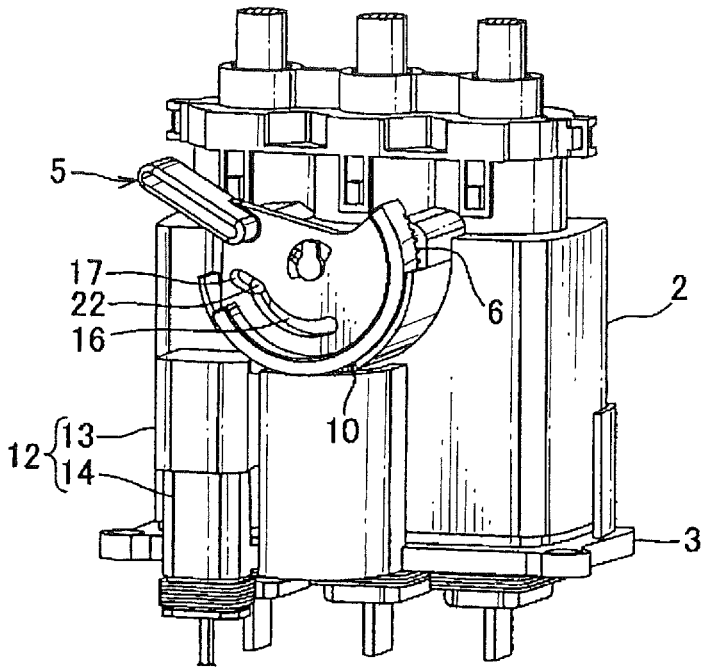
FIG. 9 A perspective view showing a condition that both connectors are finished being fitted to each other and the safety circuit unit is started to be fitted.

As shown in FIG. 9, by further rotating the driving lever 5, the first gear finishes rotating the circular gear 10 of the gear unit 8, and the upper and lower connectors 2, 3 are fully fitted with each other. The terminals in the upper and lower connectors 2, 3 are connected, however, because the safety circuit unit 12 is not fitted, the terminals in the upper and lower connectors 2, 3 are not energized. Next, the circular gear 10 enters the notch 34 of the driving lever 5, and the circular gear 10 is not driven. The driven projection 22 of the safety circuit unit 12 enters the straight groove 17 of the cam groove 16, and the fitting of the safety circuit unit 12 is started. The straight groove 17 is positioned at the upper left side.

Figure 10:
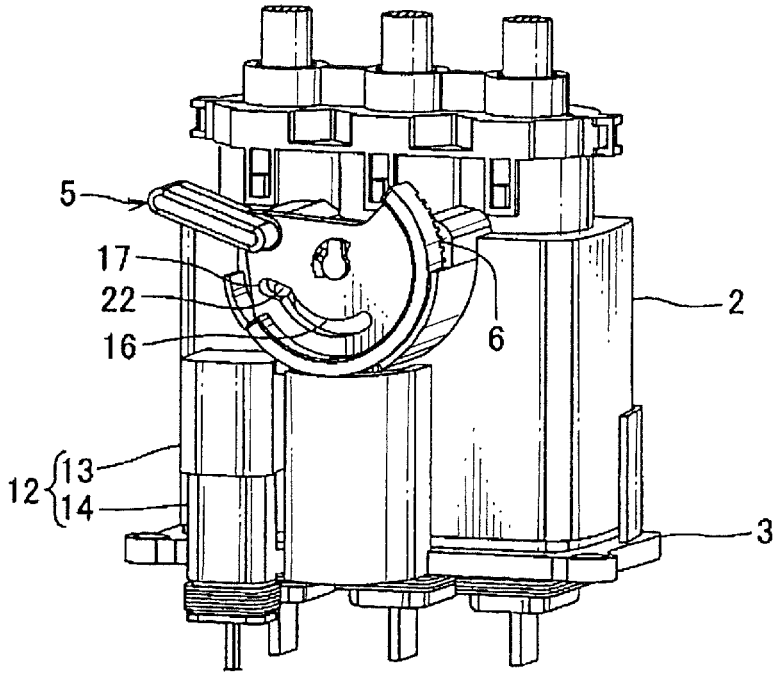
FIG. 10 A perspective view showing a condition that the safety circuit unit is halfway to be fitted.

As shown in FIG. 10, by further rotating the driving lever 5, the driven projection 22 of the safety circuit unit 12 is slidably engaged with the straight groove 17, and pushed downward together with the upper small connector 13 by the driving lever 5. Thereby, the upper small connector 13 is fitted with the lower small connector 14, and the safety circuit unit 12 is in the middle of fitting. The circular gear 10 of the gear unit 8 is positioned in the notch 34 without rotating.

Figure 11:
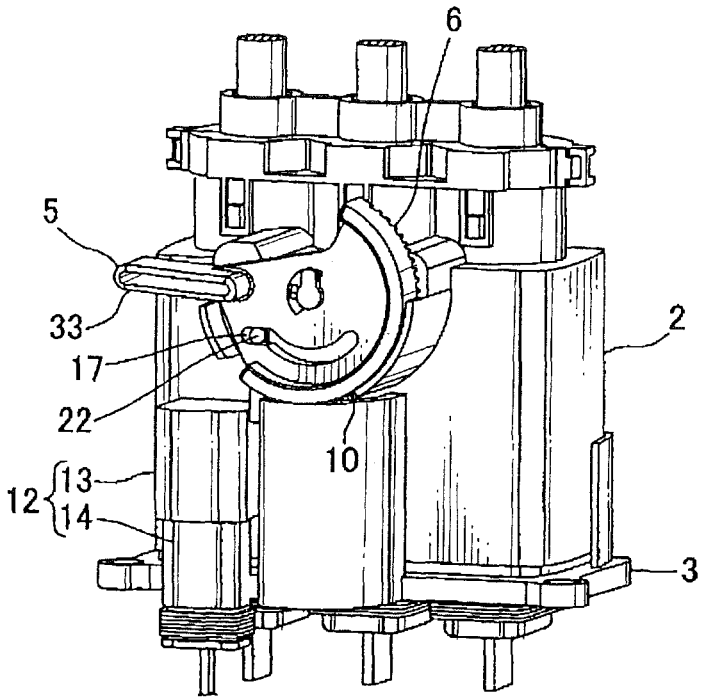
FIG. 11 A perspective view showing a condition that the safety circuit unit is finished being fitted.

As shown in FIG. 11, by further rotating the driving lever 5, the operational plate 33 is positioned substantially horizontally (a little upper left) at the left side, the driven projection 22 of the safety circuit unit 12 is positioned at the stop end of the straight groove 17, and the upper small connector 13 is completely pressed down, thereby the fitting of the safety circuit unit 12 is finished. Because the safety circuit unit 12, namely, the safety circuit is electrically connected, the terminals in the upper and lower connectors 2, 3 are electrically connected via the controller, and the main circuit is energized.

From a condition shown in FIG. 11, or in a condition shown in FIG. 11, when the second gear 7 (FIG. 6) rotates the circular gear 10 a little, and the driven projections 11 (FIG. 2) of the lower connector 3 is inserted into the horizontal straight grooves 9*b* at the upper end of the spiral groove 9 of the gear unit 8, the upper and lower connectors 2, 3 are locked, and the lower connector 3 is not moved upward to maintain the fully fitting position of the connectors 2, 3. When the locking operation is performed from the condition shown in FIG. 11, the driven projection 22 is positioned near the stop end of the straight groove 17, and the driven projection 22 is a little pressed down (fitting of the safety circuit unit 12) together with a rotation of the second gear 7.

A release operation of the upper and lower connectors 2, 3 is carried out by an inverse operation of the above operation. Namely, in FIG. 11, by rotating the operational plate 33 in a clockwise direction, the upper and lower connectors 2, 3 are unlocked. As shown in FIG. 10, the safety circuit unit 12 is in the middle of releasing. As shown in FIG. 9, the safety circuit unit 12 is almost released, and the upper and lower connectors 2, 3 are started to be released. As shown in FIG. 8, the safety circuit unit 12 is fully released, and the upper and lower connectors 2, 3 are in the middle of releasing. As shown in FIG. 7, the upper and lower connectors 2, 3 are fully released. After the safety circuit unit 12 is released and the main circuit is off (not energized), the upper and lower connecters 2, 3 are released. Therefore, a spark or the like is prevented when the upper and lower connectors 2, 3 are released, and the safety is improved.

In the low insertion force connector unit (not shown) proposed in JP, A, 2010-108084, an operator manually performs the fitting and releasing operations of the safety circuit unit. In contrast, in the low insertion force connector unit with a safety circuit unit of the present invention, both the fitting and releasing operation of the upper and lower connectors 2, 3, and the fitting and releasing operation of the safety circuit unit 12 are carried out by only a rotation of the driving lever 5, thereby a burden of the operator is reduced.

Industrial Applicability

In a low insertion force connector unit with a safety circuit unit according to the present invention, by a rotation of a driving lever, both the fitting and releasing operations of the both connectors, and the fitting and releasing operations of the safety circuit unit are carried out effectively. Namely, a main circuit of the connectors is connected and disconnected effectively. Therefore, the connector unit can be used for rapidly and safely connecting and disconnecting connectors of a circuit in, for example, electric vehicle including a hybrid vehicle.

REFERENCE SIGNS LIST

1 low insertion force connector unit with safety circuit unit
2 one connector
3 the other connector
5 driving lever
6 first gear (arc-shaped gear)
7 second gear
8 gear unit
9 spiral groove
9*b* second straight groove
10 circular gear
11 first driven projection
12 safety circuit unit
13 one small connector
14 the other small connector
16 cam groove
17 straight groove
22 second driven projection
34 notch
m center axis

The invention claimed is:

1. A low insertion force connector unit with a safety circuit unit comprising:

one connector;

the other connector;

a driving lever rotatably and pivotally supported by the one connector, and having an arc-shaped gear, an arc-shaped notch continued to the gear, an arc-shaped cam groove formed in the same radius from a center axis, and a straight groove continued to the cam groove;

a gear unit having a circular gear meshed with the arc-shaped gear and a spiral groove, and attached to the one connector;

a first driven projection provided on the other connector, and engaged with the spiral groove;

one small connector of the safety circuit unit provided on the one connector movably in a connector fitting direction;

a second driven projection provided on the one small connector; and the other small connector of the safety circuit unit fixed to the other connector, wherein the one and the other connectors are fitted to each other by meshing the arc-shaped gear with the circular gear, wherein when the connectors are fitted to each other, the second driven projection is moved along the cam groove, and wherein when the circular gear is inserted into the notch, the second driven projection is engaged with the straight groove.

2. The low insertion force connector unit with a safety circuit unit as claimed in claim 1, wherein the driving lever further has an arc-shaped second gear for locking, continued to the notch, wherein the gear unit further has a second straight groove continued to the spiral groove in a direction perpendicular to the connector fitting direction, and wherein when the second gear is meshed with the circular gear, the first driven projection is inserted into the second straight groove.

* * * * *